US009316957B2

(12) United States Patent
Yoshioka

(10) Patent No.: US 9,316,957 B2
(45) Date of Patent: Apr. 19, 2016

(54) TRANSFER DEVICE AND IMAGE FORMING APPARATUS

(71) Applicant: FUJI XEROX CO., LTD., Minato-ku, Tokyo (JP)

(72) Inventor: Tomoaki Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/108,734

(22) Filed: Dec. 17, 2013

(65) Prior Publication Data

US 2014/0341620 A1 Nov. 20, 2014

(30) Foreign Application Priority Data

May 15, 2013 (JP) ..... 2013-103407

(51) Int. Cl.
*G03G 15/20* (2006.01)
*G03G 15/16* (2006.01)

(52) U.S. Cl.
CPC ..... *G03G 15/1675* (2013.01); *G03G 15/162* (2013.01)

(58) Field of Classification Search
None
See application file for complete search history.

(56) References Cited

U.S. PATENT DOCUMENTS

| | | | | |
|---|---|---|---|---|
| 4,931,839 | A * | 6/1990 | Tompkins et al. | 399/66 |
| 2003/0099492 | A1* | 5/2003 | Maeyama et al. | 399/302 |
| 2010/0021216 | A1* | 1/2010 | Sawai | 399/302 |
| 2011/0008069 | A1* | 1/2011 | Matsushita et al. | 399/127 |
| 2012/0045231 | A1* | 2/2012 | Ogino et al. | 399/45 |

FOREIGN PATENT DOCUMENTS

| | | |
|---|---|---|
| JP | 2012-42827 A | 3/2012 |
| JP | 5142037 B2 | 2/2013 |

* cited by examiner

*Primary Examiner* — David Gray
*Assistant Examiner* — Tyler Hardman
(74) *Attorney, Agent, or Firm* — Sughrue Mion, PLLC

(57) ABSTRACT

A transfer device includes a transfer member provided so as to be able to revolve, and a voltage application unit. The transfer member has an upper layer and a lower layer arranged in a thickness direction, the upper layer has a larger volume resistivity than the lower layer. The transfer member receives a developer image transferred from an image bearing member to the upper layer at a first transfer portion and transfers the developer image to a recording medium at a second transfer portion. The voltage application unit applies an alternating-current voltage having a polarity that alternates in a moving direction of the transfer member to the transfer member, between the second transfer portion and the first transfer portion.

8 Claims, 12 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2013-103407 filed May 15, 2013.

BACKGROUND

Technical Field

The present invention relates to transfer devices and image forming apparatuses.

SUMMARY

According to an aspect of the invention, there is provided a transfer device including a transfer member provided so as to be able to revolve, and a voltage application unit. The transfer member has an upper layer and a lower layer arranged in a thickness direction. The upper layer has a larger volume resistivity than the lower layer. The transfer member receives a developer image transferred from an image bearing member to the upper layer at a first transfer portion and transfers the developer image to a recording medium at a second transfer portion. The voltage application unit applies an alternating-current voltage having a polarity that alternates in a moving direction of the transfer member to the transfer member, between the second transfer portion and the first transfer portion.

With the above-described aspect of the invention, in the configuration having the transfer member on which first transfer and second transfer of the developer image are performed, generation of residual images in the first transfer due to residual charge in the transfer member after the second transfer is suppressed, compared with a configuration in which an ac voltage having a polarity that alternates in the thickness direction of the transfer member is applied to the transfer member.

BRIEF DESCRIPTION OF THE DRAWINGS

Exemplary embodiments of the present invention will be described in detail based on the following figures, wherein.

DETAILED DESCRIPTION

First Exemplary Embodiment

An example of a transfer device and image forming apparatus according to a first exemplary embodiment will be described with reference to the drawings. First, the overall configuration and operation of the image forming apparatus will be described, and then, the configuration and operation of the transfer device, which is a principal part in the first exemplary embodiment, will be described. In the following description, a direction indicated by an arrow Z in FIG. 1 will be referred to as a "device-height direction", and a direction indicated by an arrow X in FIG. 1 will be referred to as a "device-width direction". The direction perpendicular to both the device-height direction and the device-width direction will be referred to as a "device-depth direction" (denoted by Y). When an image forming apparatus 10 is viewed from a user's (not shown) side (i.e., front view), the device-height direction, the device-width direction, and the device-depth direction will be referred to as the direction Z, the direction X, and the direction Y.

Furthermore, in the directions X, Y, and Z, when one side has to be distinguished from the other, in a front view of the image forming apparatus 10, the upper side, the lower side, the right side, the left side, the far side, and the near side will be referred to as +Z side, −Z side, +X side, −X side, +Y side, and −Y side, respectively (see FIG. 4).

Overall Configuration of Image Forming Apparatus

Figure 1:
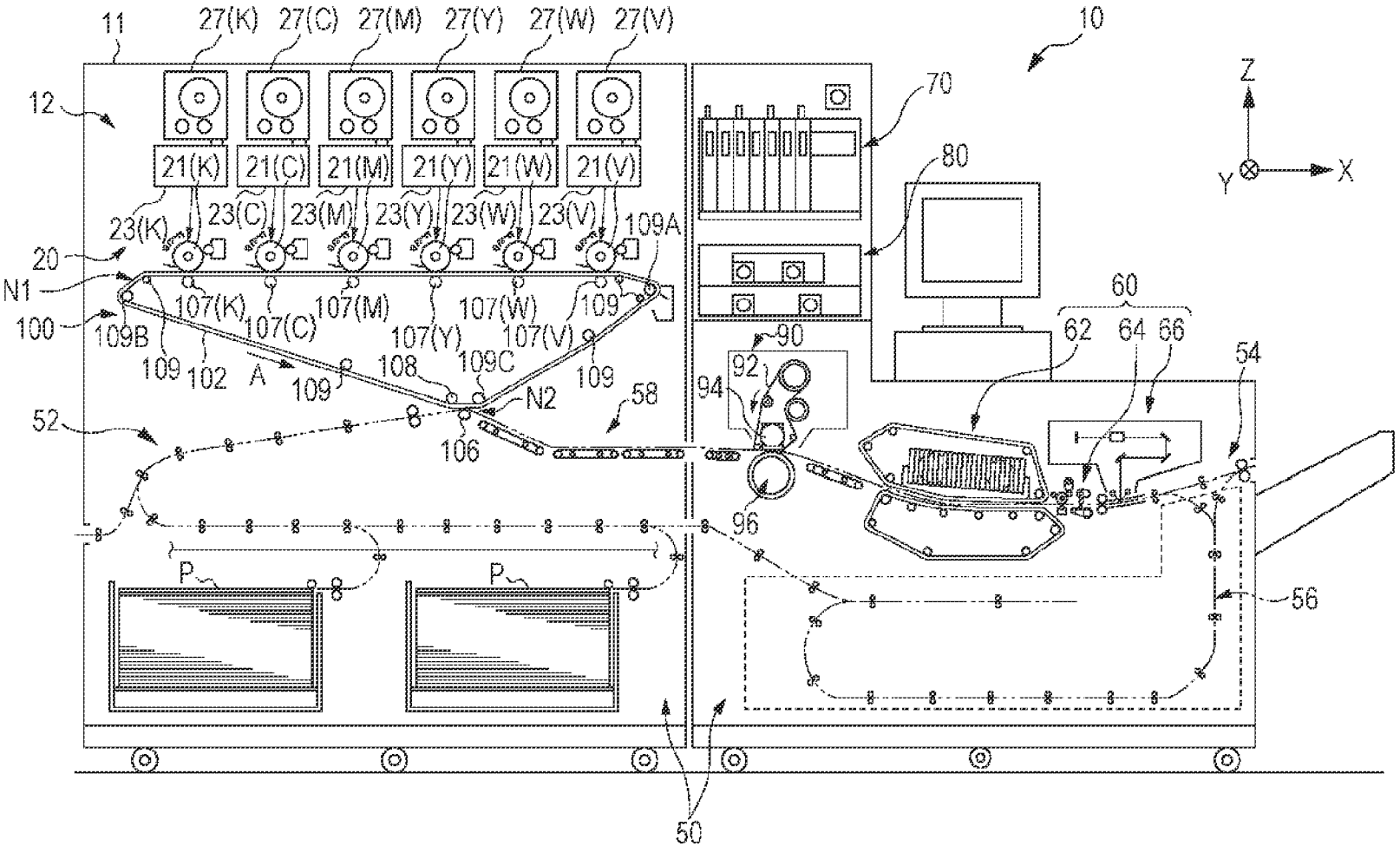
FIG. 1 is a schematic diagram showing the overall configuration of an image forming apparatus according to a first exemplary embodiment.

As shown in FIG. 1, the image forming apparatus 10 includes an image forming section 12 that forms an image on a recording sheet P, which is an example of a recording medium; a medium transport section 50 that transports the recording sheet P; and a postprocessing section 60 that performs postprocessing on the recording sheet P having the image formed thereon. The image forming apparatus 10 further includes a controller 70 that controls the aforementioned sections, and a power supply unit 80 that supplies power to the aforementioned sections, including the controller 70. The image forming apparatus 10 further includes a housing 11 that serves as a body and accommodates the image forming section 12.

Configuration of Image Forming Section

Figure 2:
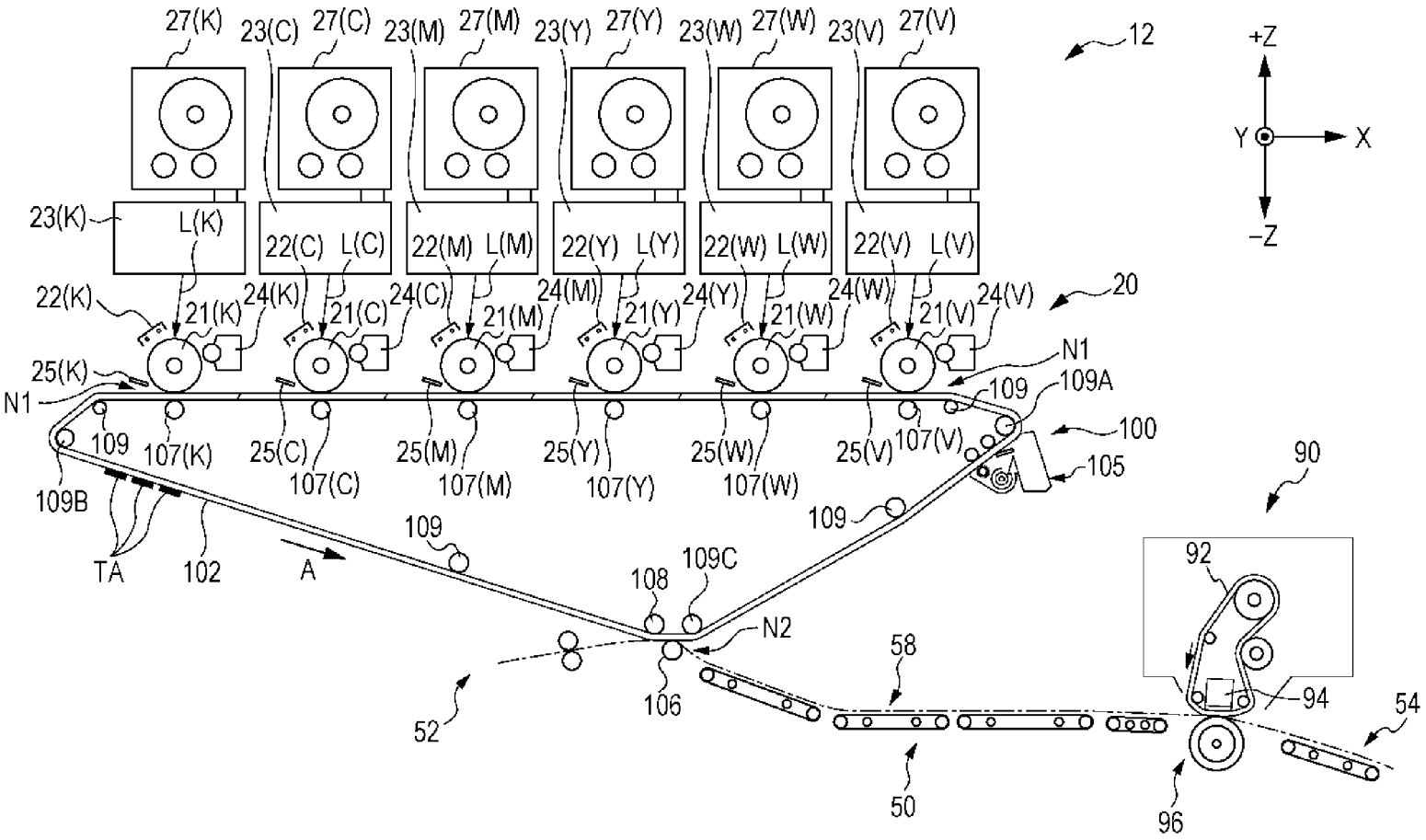
FIG. 2 is a schematic diagram showing the configuration of an image forming section according to the first exemplary embodiment.

As shown in FIG. 2, the image forming section 12 includes image forming units 20 that form toner images TA, which are an example of a developer image. Furthermore, the image forming section 12 includes a transfer device 100 that transfers the toner image TA to a recording sheet P, and a fixing device 90 that fixes the toner image TA transferred to the recording sheet P to the recording sheet P. Toner used for development is referred to as "toner T" (see FIG. 3), and the toner borne on photoconductors 21 or an intermediate transfer belt 102 (described below), or the toner transferred to the recording sheet P is referred to as the "toner image(s) TA".

The image forming unit 20 includes the photoconductors 21, which are an example of an image bearing member that bears a latent image (electrostatic latent image); chargers 22; exposure devices 23; developing devices 24; and cleaning devices 25. With this configuration, the image forming section 12 forms toner images TA by developing latent images on the photoconductors 21 with the toner T and transfers these toner images TA to the recording sheet P. In the image forming unit 20, the exposure devices 23 are fixed to the housing 11 (see FIG. 1), and the photoconductors 21, the chargers 22, the developing devices 24, and the cleaning devices 25 are fitted in a removable manner to the housing 11, in sequence in the direction Y.

The image forming section 12 includes multiple image forming units 20 to form different color toner images. In this exemplary embodiment, for example, six, in total, image forming units 20 are provided corresponding to a first special color (V), a second special color (W), yellow (Y), magenta (M), cyan (C), and black (K). The letters (V), (W), (Y), (M), (C), and (K) shown in FIG. 1 represent these colors. The transfer device 100 (described below) transfers six colors of toner images, which have been transferred in a superposed manner (first transfer) to the intermediate transfer belt 102, from the intermediate transfer belt 102 to a recording sheet P at a second transfer portion N2. The image forming units 20 have the same configuration, except for the toner they contain.

Photoconductor

Figure 3:
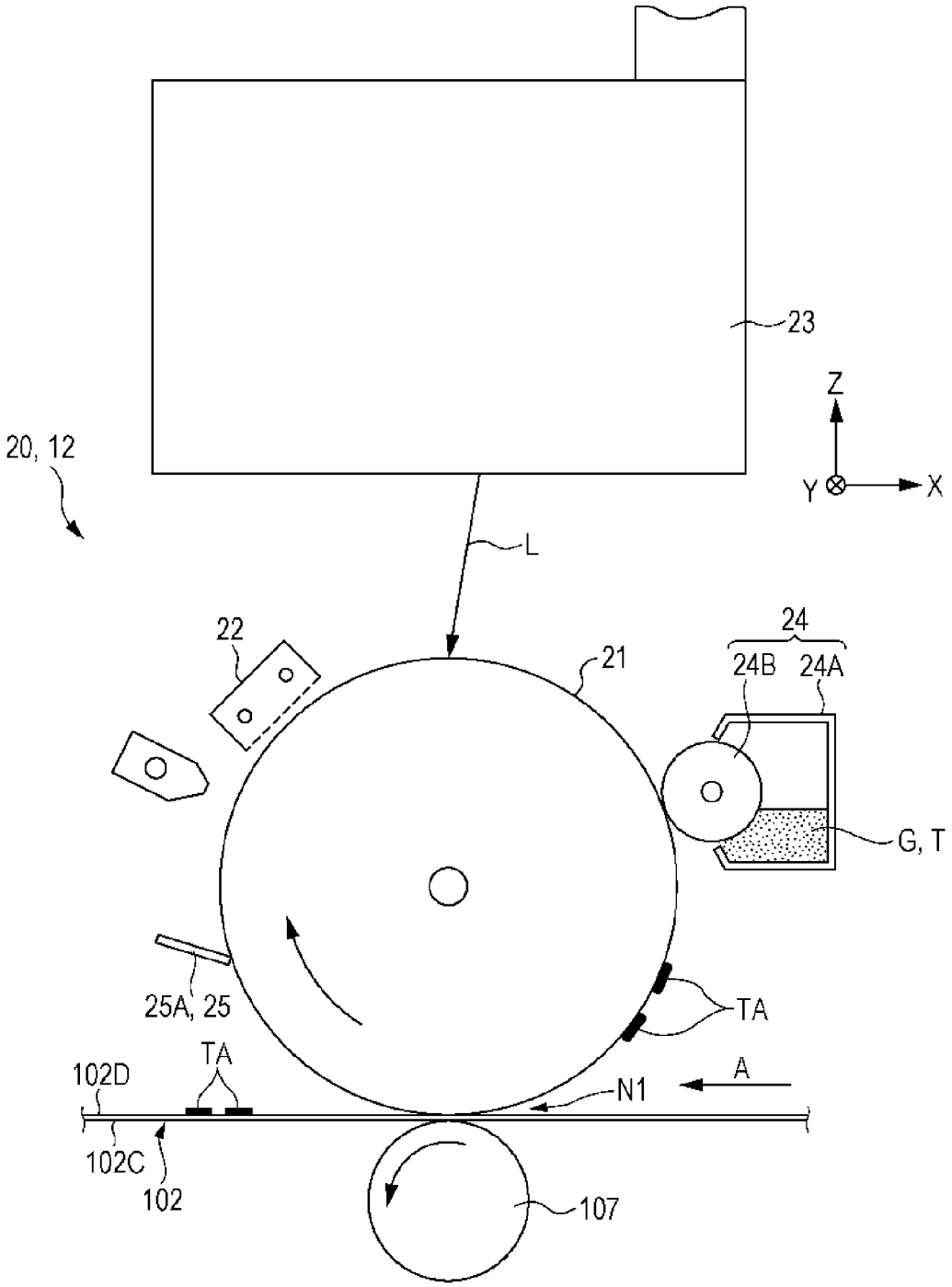
FIG. 3 is a schematic diagram showing the configuration of an image forming unit according to the first exemplary embodiment.

As shown in FIG. 3, each photoconductor 21 has a cylindrical shape and is rotated about its own shaft, which extends in the Y direction, by a driving unit (not shown). The photoconductor 21 has, for example, a negatively charged photosensitive layer (not shown) on the outer circumferential surface thereof. Furthermore, an inner base body (not shown) of the photoconductor 21 is grounded. The photoconductor 21 may have an overcoat layer on the outer circumferential surface thereof. In front view, the photoconductors 21 for the respective colors are arranged in a straight line in the direction X.

Charger

The charger 22 is disposed facing the outer circumferential surface of the photoconductor 21 and negatively charges (to the same polarity as the toner T) the outer circumferential surface (photosensitive layer) of the photoconductor 21. In this exemplary embodiment, for example, the charger 22 is a scorotron charger of a corona discharging type (non-contact charging type).

Exposure Device

The exposure device 23 forms an electrostatic latent image on the outer circumferential surface of the photoconductor 21. More specifically, the exposure device 23 radiates modulated exposure light L to the outer circumferential surface of the photoconductor 21, which has been charged by the charger 22, according to image data received from an image-signal processing unit (not shown) constituting the controller 70 (see FIG. 1). Due to the radiation of the exposure light L by the exposure device 23, an electrostatic latent image is formed on the outer circumferential surface of the photoconductor 21. In this exemplary embodiment, for example, the exposure device 23 exposes the surface of the photoconductor 21 with a laser beam radiated from a light source, using a light scanning device (optical system) including a polygon mirror and an Fθ lens. In this exemplary embodiment, the exposure device 23 is provided for each color.

Developing Device

The developing device 24 develops the electrostatic latent image formed on the outer circumferential surface of the photoconductor 21 with developer G containing the toner T, thereby forming a toner image TA on the outer circumferential surface of the photoconductor 21. Although a detailed description is not given here, the developing device 24 includes a container 24A containing the developer G and a development roller 24B that supplies the developer G contained in the container 24A to the photoconductor 21 as it rotates. A toner cartridge 27 (see FIG. 1) for supplying the developer G is connected to the container 24A through a supply path (not shown). The toner cartridges 27 for the respective colors are arranged side-by-side in the direction X, as viewed in the direction Y, adjacent to the photoconductors 21 and the exposure devices 23 in an independently replaceable manner.

Toner

The toner T includes, for example, toner particles containing binder resin, colorant, and other additives, such as release agent (if necessary); and an external additive (if necessary). In this exemplary embodiment, for example, a two-component developer containing the toner T and carrier (not shown) is used. The toner T is negatively (minus) charged by the contact with the carrier.

Cleaning Device

The cleaning device 25 includes a blade 25A for scraping off the toner T left on the surface of the photoconductor 21 after the toner image TA has been transferred to the transfer device 100 (see FIG. 2). Although not shown in the figures, the cleaning device 25 further includes a housing in which the toner T scraped off by the blade 25A is collected, and a transport device that transports the toner T in the housing to a waste toner box.

Transfer Device

As shown in FIG. 2, the transfer device 100 first-transfers the toner images TA on the photoconductors 21 for the respective colors to the intermediate transfer belt 102, in a superposed manner, at first transfer portions N1 and second-transfers the superposed toner image TA to the recording sheet P at the second transfer portion N2. Furthermore, a belt cleaner 105 that comes into contact with the intermediate transfer belt 102 to clean the surface thereof is provided facing the outer circumferential surface of the intermediate transfer belt 102, near the roller 109A (described below). The details of the transfer device 100 will be described below.

Fixing Device

The fixing device 90 includes, for example, a fixing belt 92 that is wound around multiple rollers, which have heat sources, so as to be able to revolve, a pad 94 provided inside the fixing belt 92, and a pressure roller 96 that presses the fixing belt 92 and the recording sheet P toward the pad 94. The fixing device 90 heats the toner image TA transferred by the transfer device 100 to fix the toner image TA to the recording sheet P.

Medium Transport Section

As shown in FIG. 1, the medium transport section 50 includes a medium feeding portion 52 that feeds a recording sheet P to the image forming section 12, an intermediate transport portion 58 that transports the recording sheet P from the transfer device 100 to the fixing device 90, and a medium discharge portion 54 that discharges the recording sheet P having gone through the fixing process. The medium transport section 50 further includes a medium returning portion 56 that is used when images are to be formed on both sides of the recording sheet P.

The medium feeding portion 52 feeds recording sheets P to the second transfer portion N2 in the image forming section 12 on a one-by-one basis, in accordance with the timing of transfer. The medium discharge portion 54 discharges the recording sheet P on which the toner image TA is fixed (an image is formed) by the fixing device 90 to the outside of the device. When a toner image TA is to be formed on the other side of the recording sheet P having the toner image TA fixed on one side thereof, the medium returning portion 56 reverses the recording sheet P and sends it back to the image forming section 12 (the medium feeding portion 52).

Postprocessing Section

The postprocessing section 60 includes a medium cooling portion 62 that cools the recording sheet P having the image formed in the image forming section 12; a straightening device 64 that straightens the curled recording sheet P; and an image inspection portion 66 that inspects the image formed on the recording sheet P. The medium cooling portion 62, the straightening device 64, and the image inspection portion 66 are arranged in the medium discharge portion 54 in sequence from the upstream side in the recording-sheet discharging direction and perform the above-described postprocessing on the recording sheet P that is being discharged by the medium discharge portion 54.

Image Formation Operation

Next, the outline of the image forming process performed on a recording sheet P by the image forming apparatus 10 and the subsequent postprocessing process will be described.

As shown in FIG. 1, upon receipt of an image forming command, the controller 70 activates the image forming units 20, the transfer device 100, and the fixing device 90. As a result, as shown in FIG. 2, the photoconductors 21 and the development rollers 24B (see FIG. 3) are rotated, and the intermediate transfer belt 102 is revolved. Furthermore, the fixing belt 92 is revolved. In synchronization with these operations, the controller 70 activates the medium transport section 50, etc.

The photoconductors 21 for the respective colors are charged by the chargers 22 while being rotated. The controller 70 (see FIG. 1) sends image data having undergone image processing in the image-signal processing unit to each exposure device 23. Each exposure device 23 emits exposure light L to the corresponding charged photoconductor 21 according to the image data. As a result, electrostatic latent images are formed on the outer circumferential surfaces of the photoconductors 21. The electrostatic latent images formed on the photoconductors 21 are developed with the developer (toner T) supplied from the developing devices 24. As a result, toner images TA in the first special color (V), the second special color (W), yellow (Y), magenta (M), cyan (C), and black (K) are formed on the photoconductors 21.

The color toner images TA formed on the photoconductors 21 for the respective colors are sequentially transferred (first transfer) to the revolving intermediate transfer belt 102, at the first transfer portions N1, due to application of a first-transfer bias voltage via first transfer rollers 107 for the respective colors. As a result, a superposed toner image TA, in which six colors of toner images TA are superposed on one another, is formed on the intermediate transfer belt 102. This toner image TA is transported to the second transfer portion N2 as the intermediate transfer belt 102 revolves.

A recording sheet P is fed to the second transfer portion N2 by the medium feeding portion 52, in accordance with the timing of transporting the toner image TA. When a second-transfer bias voltage is applied at the second transfer portion N2, the toner image TA is transferred (second transfer) from the intermediate transfer belt 102 to the recording sheet P.

The recording sheet P to which the toner image TA has been transferred is transported from the second transfer portion N2 of the transfer device 100 to a fixing nip portion of the fixing device 90 by the intermediate transport portion 58, while being subjected to negative pressure suction. The fixing device 90 applies heat and pressure (fixing energy) to the recording sheet P passing through the fixing nip portion. As a result, the toner image TA transferred to the recording sheet P is fixed to the recording sheet P.

The recording sheet P discharged from the fixing device 90 is processed by the postprocessing section 60 while being transported toward a discharged medium receiving portion outside the apparatus by the medium discharge portion 54. More specifically, first, the recording sheet P heated in the fixing process is cooled by the medium cooling portion 62. Next, the curled recording sheet P is straightened by the straightening device 64. Then, the toner image fixed to the recording sheet P is inspected for the presence/absence and level of a toner density defect, an image defect, and an image position defect by the image inspection portion 66. Then, the recording sheet P is transported to the medium discharge portion 54.

When a toner image TA is to be formed on a non-image surface (a surface having no toner image TA) of the recording sheet P (that is, when double-sided printing is to be performed), the controller 70 switches the transportation path for the recording sheet P after passing the image inspection portion 66 from the medium discharge portion 54 to the medium returning portion 56. As a result, the recording sheet P is reversed and sent to the medium feeding portion 52. A toner image TA is formed (fixed) on the back surface of the recording sheet P through the same process as the above-described image forming process performed on the front surface. The recording sheet P is discharged from the apparatus by the medium discharge portion 54 after going through the same postprocessing as that performed on the front surface after the image is formed.

Configuration of Principal Part

Next, the transfer device 100 will be described.

As shown in FIG. 2, the transfer device 100 includes the intermediate transfer belt 102, which is an example of a transfer member or a belt, the first transfer rollers 107, and the second transfer roller 106, which is an example of a second electrode member. The transfer device 100 also includes a backup roller 109C, which is an example of a first electrode member, and a power supply 110 (see FIG. 4) which supplies a voltage to the backup roller 109C. The power supply 110, the backup roller 109C, and the second transfer roller 106 are an example of a voltage application unit.

Intermediate Transfer Belt

Figure 4A:
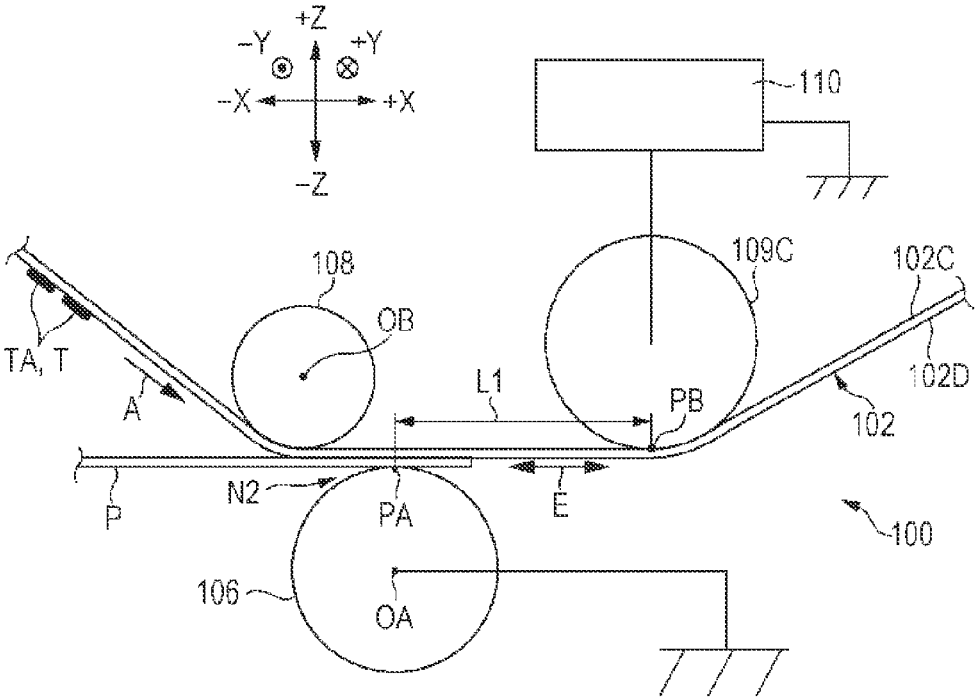
FIG. 4A is a schematic diagram showing the configuration of a second transfer portion of a transfer device and the vicinity thereof according to the first exemplary embodiment.
Figure 4B:
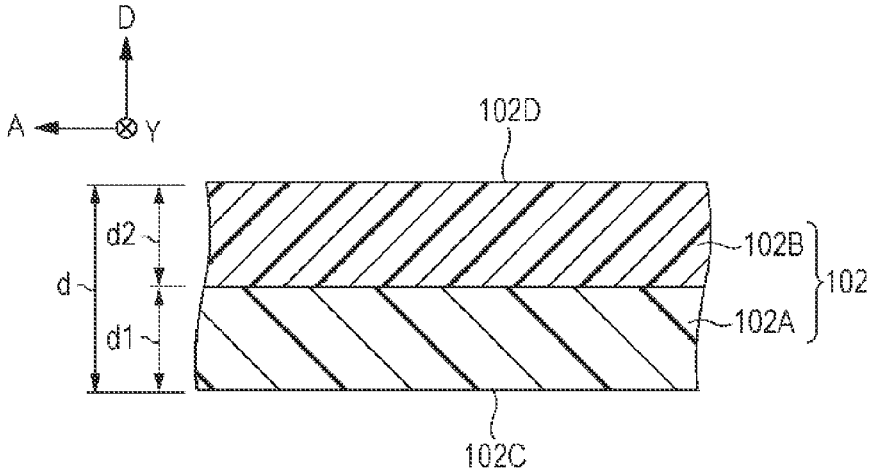
FIG. 4B is a diagram showing the configuration of an intermediate transfer belt according to the first exemplary embodiment.

The intermediate transfer belt 102 is an endless (cylindrical) belt made of, for example, polyimide resin. The intermediate transfer belt 102 contains carbon black, serving as a conducting agent, for controlling the surface resistivity. As shown in FIG. 4B, when the intermediate transfer belt 102 moves in a direction A (indicated by an arrow A), a direction D (indicated by an arrow D), which is the thickness direction of the intermediate transfer belt 102, is perpendicular to the directions A and Y.

More specifically, the intermediate transfer belt 102 includes at least two layers, namely, a lower layer 102A on the inner side and an upper layer 102B on the outer circumferential surface side of the lower layer 102A. Furthermore, in the intermediate transfer belt 102, the upper layer 102B contains less carbon black per unit volume than the lower layer 102A.

That is, in the intermediate transfer belt 102, the upper layer 102B has greater volume resistivity (higher resistivity) in the direction D than the lower layer 102A. The reason why the lower layer 102A has lower resistivity is to avoid residual charge in the intermediate transfer belt 102 when separation discharge occurs between the intermediate transfer belt 102 and the backup roller 109C. Note that the inner surface of the lower layer 102A in the direction D is an inner circumferential surface 102C, and the outer surface of the upper layer 102B is an outer circumferential surface 102D. The toner images TA are first-transferred to the outer circumferential surface 102D.

Furthermore, the intermediate transfer belt 102 has a total thickness d (sum of the thickness d1 of the lower layer 102A and the thickness d2 of the upper layer 102B) of, for example, from 50 μm to 130 μm. The mechanical strength requirement is met with a total thickness d of 50 μm or more, and the flexibility requirement is met with a total thickness d of 130 μm or less.

The materials of the lower layer 102A and upper layer 102B of the intermediate transfer belt 102 are not limited to the above-described polyimide resin, but may be a thermoplastic resin, such as polyvinylidene fluoride resin, polyalkylene phthalate resin, composite of polycarbonate and polyalkylene phthalate, or ethylene tetrafluoroethylene copolymer; or a heat-curable resin, such as polycarbonate resin or polyamide-imide copolymer (polyamide-imide), with conducting agent dissolved or dispersed therein.

Note that the intermediate transfer belt 102 may have an inner circumferential surface layer formed on the inner circumferential surface of the lower layer 102A, and an outer circumferential surface layer formed on the outer circumferential surface of the upper layer 102B. Furthermore, the intermediate transfer belt 102 may have an intermediate layer formed between the lower layer 102A and the upper layer 102B.

As shown in FIG. 2, the intermediate transfer belt 102 bears, on the outer circumferential surface thereof, the toner images TA formed in the image forming units 20. Furthermore, the intermediate transfer belt 102 is wound around the rollers 109 and is held in place so as to be able to revolve. In this exemplary embodiment, for example, the intermediate transfer belt 102 has an inverted obtuse triangular shape elongated in the direction X, as viewed in the direction Y.

Of these rollers 109, a roller 109A disposed near the image forming unit 20 for the first special color (V) functions as a driving roller that rotates the intermediate transfer belt 102 in the direction A (circumferential direction) using power generated by a motor (not shown). Furthermore, a roller 109B disposed near the image forming unit 20 for black (K) functions as a tension applying roller that applies tension to the intermediate transfer belt 102. The backup roller 109C is disposed at the obtuse apex of the intermediate transfer belt 102 located on the −Z direction side.

Winding Roller

A winding roller 108, around which the intermediate transfer belt 102 is wound, is disposed on the upstream side of the backup roller 109C in the direction A, in which the intermediate transfer belt 102 revolves. More specifically, as shown in FIG. 4A, the center of rotation, OB, of the winding roller 108 is disposed to the −X side (upstream side) of the center of rotation, OA, of the second transfer roller 106. The winding roller 108 is located at a position shifted from a transfer current path between the backup roller 109C and the second transfer roller 106.

The winding roller 108 has a shaft (not shown) that serves as a rotation shaft extending in the direction Y. This shaft is parallel to the roller 109 and the first transfer rollers 107 (see FIG. 2) and is supported by bearing members (not shown) at both ends in the direction Y so as to be rotatable. The winding roller 108 is, for example, electrically floating (not grounded).

Backup Roller

The backup roller 109C has a shaft (not shown) serving as a rotation shaft extending in the direction Y. This shaft is parallel to the winding roller 108 and is supported by bearing members (not shown) at both ends in the direction Y so as to be rotatable. As shown in FIG. 4A, the outer circumferential surface of the backup roller 109C is in contact with the inner circumferential surface 102C of the intermediate transfer belt 102 at the second transfer portion N2 (described below). Furthermore, the power supply 110 (described below) is electrically connected to this shaft.

Second Transfer Roller

The second transfer roller 106 has a shaft (not shown) serving as a rotation shaft extending in the direction Y. This shaft is parallel to the winding roller 108, is supported by bearing members (not shown) at both ends in the direction Y, and is rotated by a motor (not shown). Furthermore, the outer circumferential surface of the second transfer roller 106 is in contact with the outer circumferential surface 102D of the intermediate transfer belt 102 at the second transfer portion N2 (described below).

The shaft of the second transfer roller 106 is, for example, grounded. As will be described below, the second transfer roller 106 and the backup roller 109C are spaced apart in the moving direction of the intermediate transfer belt 102 (direction A).

Power Supply

As shown in FIG. 4A, the power supply 110 applies a superposed voltage having an alternating polarity, which includes, for example, a negative (the same polarity as the toner T) direct-current voltage (dc voltage) and a sinusoidal ac voltage superposed thereon, to the backup roller 109C. That is, the power supply 110 applies a superposed voltage, which includes a transfer voltage (for example, a dc voltage) used for second transfer and an ac voltage for changing polarity superposed thereon, at the second transfer portion N2 and also serves as a transfer power supply. Note that "having an alternating polarity" not only means that the direction in which the voltage varies changes, but also the polarity of the applied voltage alternates around 0 V.

Herein, as described above, the second transfer roller 106 is grounded, so, the power supply 110 causes a potential difference between the backup roller 109C and the second transfer roller 106. The superposed voltage is applied (an electric current flows) in the direction A, which is the revolving direction of the intermediate transfer belt 102. In the description below, the direction in which the superposed voltage is applied (the direction in which the polarity changes) is indicated by a double-headed arrow and is referred to as a surface direction E, which may be sometimes distinguished from the direction A.

First Transfer Portion

As shown in FIG. 2, the upper side of the intermediate transfer belt 102 extending in the direction X is supported by the first transfer rollers 107, in the above-described orientation, so as to be in contact with the outer circumferential surfaces of the photoconductors 21 for the respective colors from the −Z direction side. Herein, the outer circumferential surfaces of the photoconductors 21 and the outer surface of the intermediate transfer belt 102 are in contact with each other at the first transfer portions N1. At the first transfer portions N1, toner images TA on the photoconductors 21 are first-transferred to the intermediate transfer belt 102 due to the effect of an electric field generated by a potential difference between the grounded photoconductors 21 and the first transfer rollers 107, to which a dc voltage having an opposite polarity to the toner T is applied by the power supply (not shown).

Second Transfer Portion

In FIG. 4A, an area between a portion at which the outer circumferential surface of the intermediate transfer belt 102 is in contact with the outer circumferential surface of the second transfer roller 106 and a portion at which the inner circumferential surface of the intermediate transfer belt 102 is in contact with the backup roller 109C is referred to as the second transfer portion N2.

In an X-Z plane, the outer circumferential surface of the intermediate transfer belt 102 is in contact with the outer circumferential surface of the second transfer roller 106 at a point PA, and the inner circumferential surface of the intermediate transfer belt 102 is in contact with the outer circumferential surface of the backup roller 109C at a point PB. The distance between the backup roller 109C and the second transfer roller 106 is a distance L1, which is the distance between the point PA and the point PB in the direction X (the direction A). The distance L1 is set to, for example, about 10 mm. Note that FIG. 4A does not show the actual dimensional relationship between these components.

In the transfer device 100, when the power supply 110 applies a superposed voltage to the backup roller 109C, a transfer current flows from the backup roller 109C to the second transfer roller 106 through the intermediate transfer belt 102. As a result, at the second transfer portion N2, the toner image TA on the intermediate transfer belt 102 is second-transferred to a recording sheet P passing through the second transfer portion N2 (see FIG. 1).

Figure 5A:
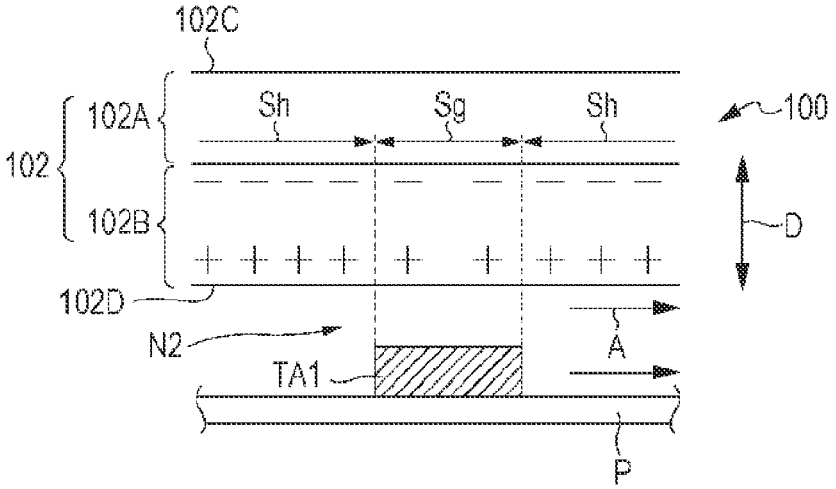
FIGS. 5A, 5B, and 5C are schematic diagrams showing charge distribution in an image portion and a non-image portion of the intermediate transfer belt, at a second transfer portion, between the second transfer portion and a first transfer portion, and at the first transfer portion, respectively, according to the first exemplary embodiment.
Figure 5B:
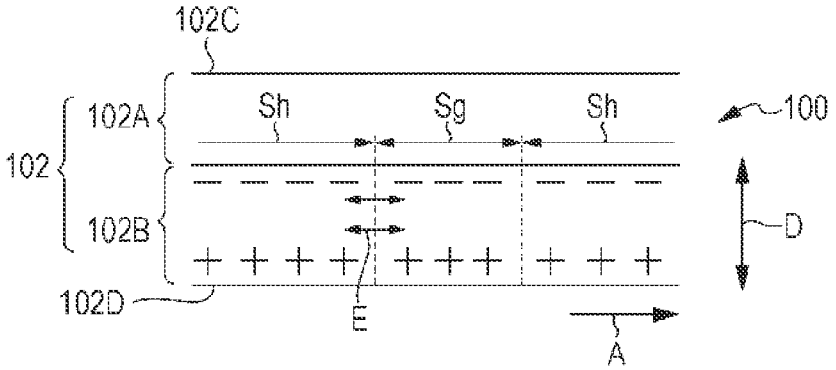
Figure 5C:
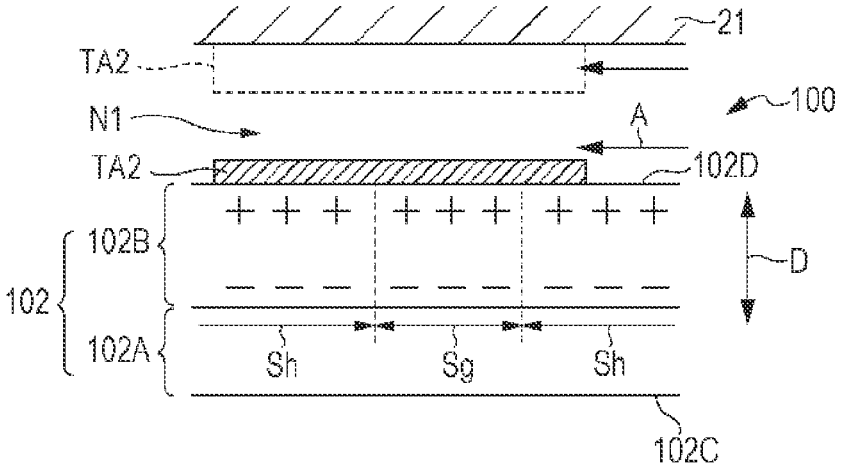

As shown in FIGS. 5A, 5B, and 5C, in the intermediate transfer belt 102, in the direction A, a region to which the toner image TA1 is transferred is referred to as an image portion Sg, and a region to which the toner image TA1 is not transferred is referred to as a non-image portion Sh. Although a detailed description will be given below, by making the amount of residual charges in the image portions Sg and that in the non-image portions Sh uniform, the potential difference between the intermediate transfer belt 102 and the photoconductors 21 at the first transfer portions N1 decreases compared with a case where the amount of residual charge in the image portion Sg is large. However, in this exemplary embodiment, the controller 70 (see FIG. 1) adjusts the level of the dc voltage applied to the first transfer rollers 107 (see FIG. 2) according to the image data (the image portion Sg and the non-image portion Sh) to compensate for the decrease in potential difference. Thus, even if a potential step between the image portion Sg and the non-image portion Sh is leveled, the amount of toner T transferred to the intermediate transfer belt 102 in the first transfer is hardly affected.

Comparative Example

Figure 10A:
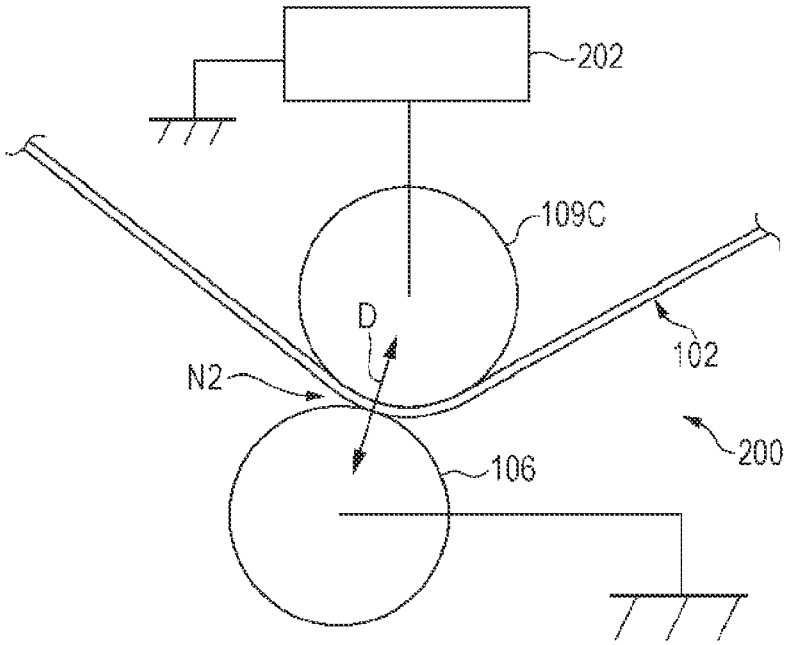
FIGS. 10A and 10B are schematic diagrams showing the configuration of a second transfer portion of a transfer device and the vicinity thereof according to a Comparative Example.

FIG. 10A shows a transfer device 200 according to a Comparative Example, in which the winding roller 108 (see FIG. 4) is removed, and the backup roller 109C and the second transfer roller 106 face each other with the intermediate transfer belt 102 therebetween. Note that a power supply 202 that applies a superposed voltage (described above) to the backup roller 109C is electrically connected to the backup roller 109C.

Figure 11A:
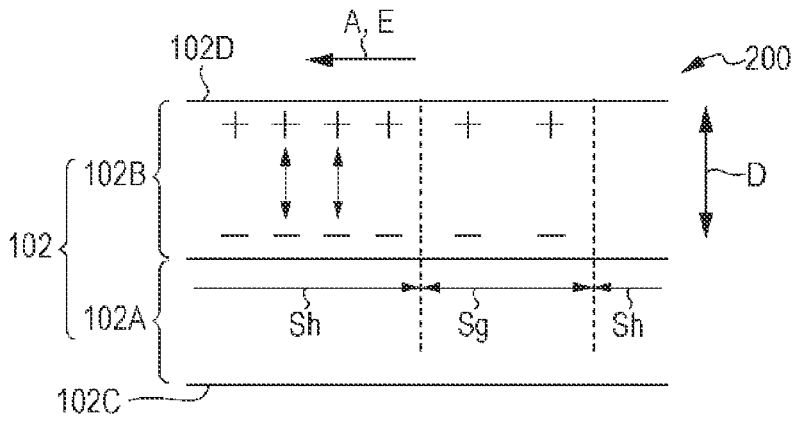
FIGS. 11A, 11B, and 11C are schematic diagrams showing a change in charging polarity in the thickness direction of an intermediate transfer belt according to the Comparative Example.
Figure 11B:
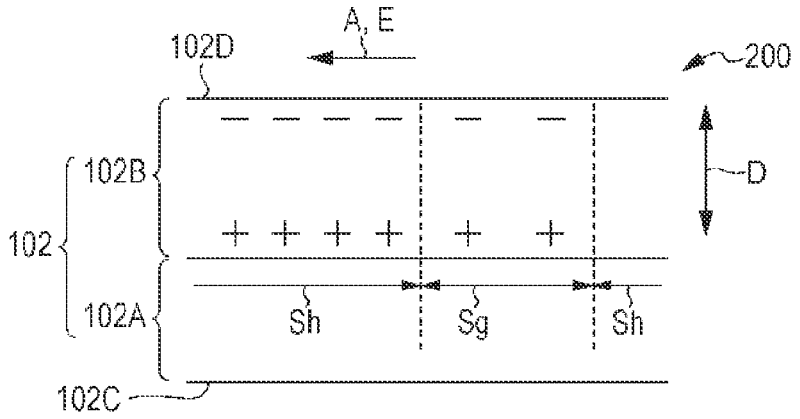
Figure 11C:
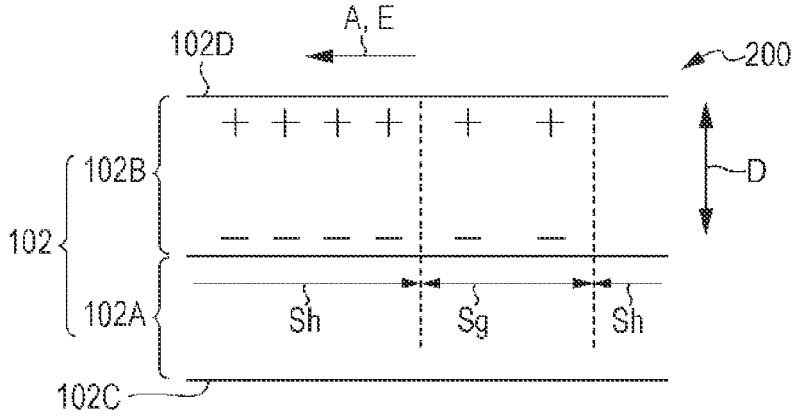

In the transfer device 200 according to the Comparative Example, because the backup roller 109C and the second transfer roller 106 face each other, when the power supply 202 applies a superposed voltage to the backup roller 109C, the superposed voltage is applied in the direction D (i.e., the thickness direction). At this time, as shown in FIGS. 11A, 11B, and 11C, in the upper layer 102B of the intermediate transfer belt 102, the polarity of the outer side portion and the polarity of the inner side portion switch as the polarity of the superposed voltage is changed.

However, in the transfer device 200 according to the Comparative Example, because the superposed voltage is applied in the thickness direction (direction D), the polarity hardly changes in the surface direction E of the intermediate transfer belt 102. Thus, the charges hardly move between the image portions Sg and the non-image portions Sh.

Figure 12A:
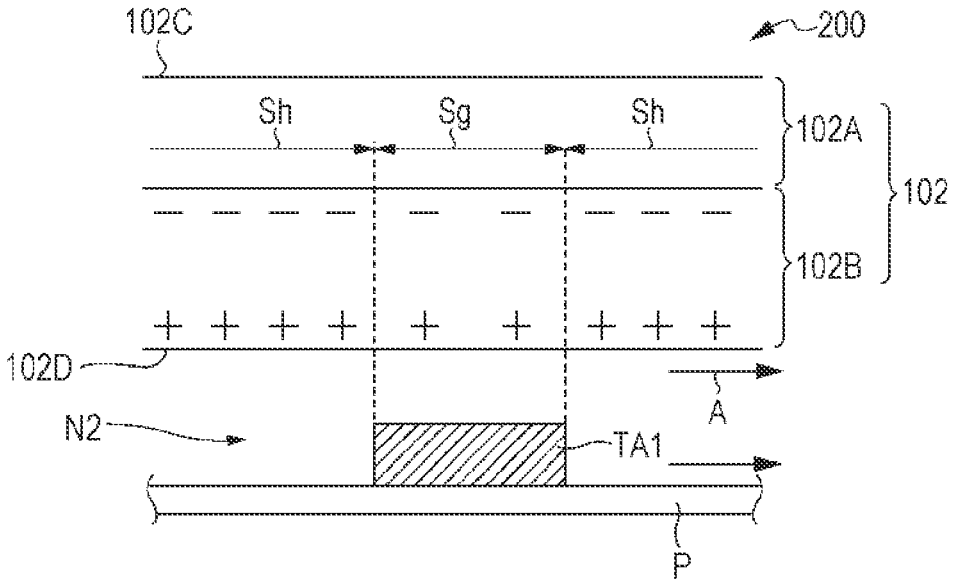
FIGS. 12A and 12B are schematic diagrams showing charge distribution in an image portion and a non-image portion of the intermediate transfer belt, at the second transfer portion and at a first transfer portion, according to the Comparative Example.

Herein, as shown in FIG. 12A, in the transfer device 200 according to the Comparative Example, when a toner image TA1 formed in the first image formation is second-transferred to a recording sheet P at the second transfer portion N2, the amount of residual charge in the image portion Sg of the intermediate transfer belt 102 becomes lower than that in the non-image portion Sh. If the amount of residual charge in the intermediate transfer belt 102 is low, the potential difference between the grounded photoconductors 21 and the intermediate transfer belt 102 at the first transfer portions N1 (see FIG. 2) is small. That is, potential steps are created at the boundaries of the image portions Sg and the non-image portions Sh.

Figure 12B:
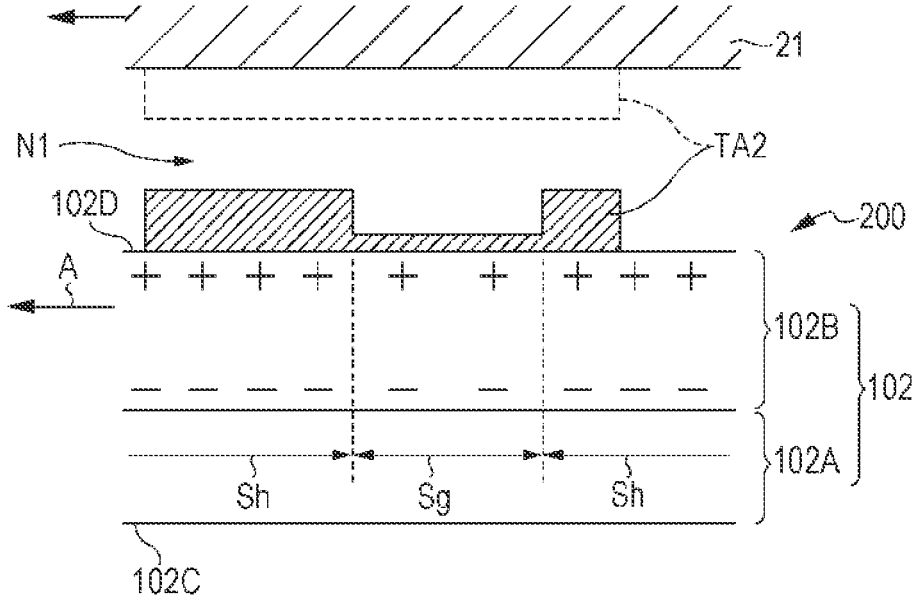

Subsequently, as shown in FIG. 12B, when the intermediate transfer belt 102 revolves in the circumferential direction and reaches the first transfer portions N1, toner images TA2, which are formed in the second image formation and are different from the toner images TA1, are first-transferred from the photoconductors 21 to the intermediate transfer belt 102. At this time, potential steps are created at the boundaries of the image portions Sg and the non-image portions Sh formed in the first transfer operation. Thus, in the toner image TA2 first-transferred to the intermediate transfer belt 102, the amount of toner deposited on the previous image portions Sg is smaller than that on the previous non-image portions Sh, and this difference in the amount of deposited toner results in residual images.

Figure 10B:
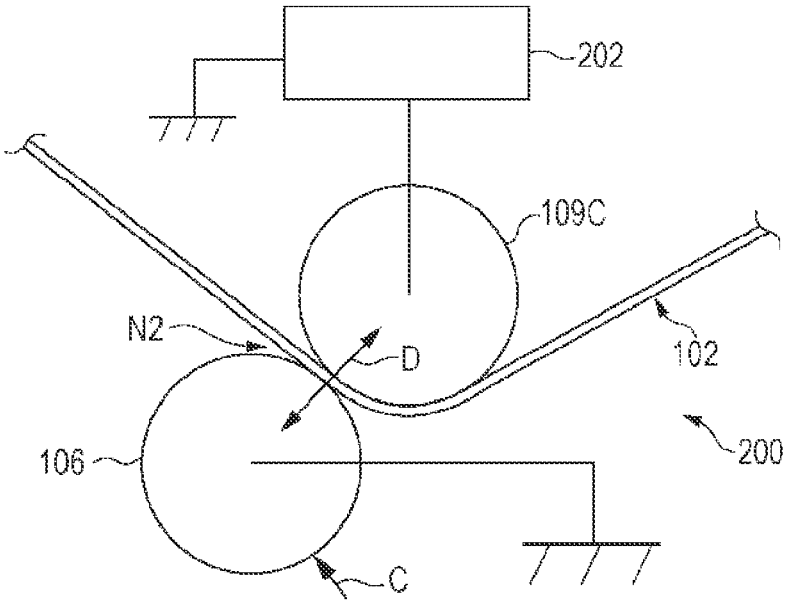

Note that, in the transfer device 200 according to the Comparative Example, even if the position of the second transfer roller 106 is shifted in an arrow C direction (obliquely above) as shown in FIG. 10B, the application direction of the superposed voltage at the second transfer portion N2 remains the direction D, so, the residual image is hardly eliminated.

Figure 9:
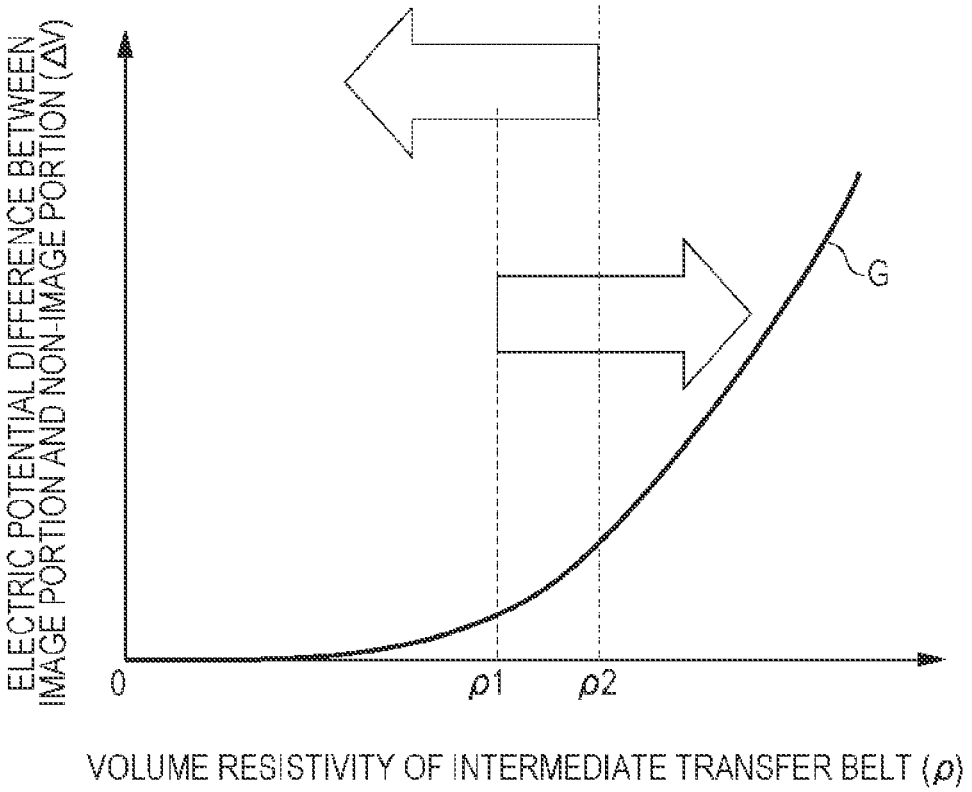
FIG. 9 is a graph schematically showing the relationship between the volume resistivity of the intermediate transfer belt and the potential difference between an image portion and a non-image portion, according to the first exemplary embodiment.

FIG. 9 is a graph illustrating a change, G, in potential difference ΔV (corresponding to the potential step) between the image portion (Sg) and the non-image portion (Sh) with respect to the volume resistivity, ρ, of the intermediate transfer belt 102 (see FIG. 2). In the graph, the potential difference ΔV increases in a parabolic manner with the increase in the volume resistivity ρ. This may be because the amount of residual charge in the intermediate transfer belt 102 increases with the increase in the volume resistivity ρ, leading to large difference in the amount of residual charge between the image portion Sg and the non-image portion Sh and large potential difference ΔV.

In the graph, when the volume resistivity of the intermediate transfer belt 102 is smaller than ρ2, the minus charge of the toner T is discharged easily, making it difficult to transfer the toner T (the toner image TA). Thus, an appropriate volume resistivity of the intermediate transfer belt 102 is ρ2 or more. On the other hand, in the graph, when the volume resistivity of the intermediate transfer belt 102 is ρ1 (<ρ2) or more, although the discharge from the toner T is suppressed, the amount of residual charge in the intermediate transfer belt 102 increases, as described above, resulting in generation of residual images.

In the transfer device 200 according to the Comparative Example (see FIG. 10A), although it is possible to make the intermediate transfer belt 102 have a volume resistivity of ρ2 or more, it is difficult to suppress generation of residual images in the first transfer portions N1.

Advantages

Next, advantages of the first exemplary embodiment will be described.

In the transfer device 100 shown in FIG. 4A, the backup roller 109C and the second transfer roller 106 are disposed at the distance L1 from each other in the direction X. Thus, as described above, when the power supply 110 applies a superposed voltage to the backup roller 109C, a transfer current flows from the backup roller 109C to the second transfer roller 106 through the intermediate transfer belt 102, in the surface direction E. As a result, as shown in FIG. 5A, at the second transfer portion N2, the toner image TA1 (formed in the first image formation and first-transferred at the first transfer portions N1 (see FIG. 2)) on the intermediate transfer belt 102 is second-transferred to a recording sheet P passing through the second transfer portion N2 in the direction A.

After the toner image TA1 is second-transferred, the amount of residual charge in the image portion Sg of the intermediate transfer belt 102 is lower than that of the non-image portion Sh, because the charges are exchanged between the intermediate transfer belt 102 and the toner image TA1. As a result, potential steps are created at the boundaries of the image portions Sg and the non-image portions Sh. Note that the polarity of the lower layer 102A is not shown because it has low resistivity and, hence, has a minor influence on generation of residual images.

Next, as shown in FIG. 4A, while the portion of the intermediate transfer belt 102 on which the second transfer was performed is moving from the point PA to the point PB in the direction A, the direction of the superposed voltage applied by the power supply 110 is the surface direction E (the direction A) of the intermediate transfer belt 102. That is, the power supply 110 applies a superposed voltage, which includes an ac voltage having a polarity that alternates in the direction A, to the intermediate transfer belt 102, between the second transfer portion N2 and the first transfer portions N1 (see FIG. 3).

As a result, as shown in FIG. 5B, in the upper layer 102B of the intermediate transfer belt 102, the polarity changes in the surface direction E, and the charges move at the boundaries of the image portions Sg and the non-image portions Sh. Thus, the amount of residual charges in the image portions Sg and that in the non-image portions Sh become uniform.

Subsequently, as shown in FIG. 5C, when the intermediate transfer belt 102 revolves in the circumferential direction and reaches the first transfer portions N1, toner images TA2 (formed in the second image formation and different from the toner images TA1) are first-transferred from the photoconductors 21 to the intermediate transfer belt 102. At this time, because the amount of residual charges in the image portions Sg and that in the non-image portions Sh have been made uniform (i.e., the potential steps have been reduced), in the toner image TA2 first-transferred to the intermediate transfer belt 102, the amount of toner deposited on the previous image portions Sg and that on the previous non-image portions Sh are uniform. Hence, in the transfer device 100, generation of residual images in the first transfer portions N1 is suppressed.

That is, in the transfer device 100, by making the intermediate transfer belt 102 have a volume resistivity of ρ2 or more (see FIG. 9), electrical discharge from the toner T is suppressed, and generation of residual images in the first transfer portions N1 is suppressed. Thus, the transfer device 100 has a larger allowance (latitude) of the volume resistivity, ρ, of the intermediate transfer belt 102 than the transfer device 200 according to the Comparative Example (see FIG. 10A).

Furthermore, in the transfer device 100, a superposed voltage is applied to the backup roller 109C and the second transfer roller 106, which are disposed at the distance L1 from each other and serve as an example of two electrode members. Thus, movement of charges at the boundaries of the image portions Sg and the non-image portions Sh may be controlled not only by changing the amplitude and frequency of the superposed voltage at the power supply 110, but also by changing the distance L1 (described below). Thus, in the transfer device 100, generation of residual images in the first transfer portions N1 is further suppressed, compared with a configuration in which such two electrode members are not provided.

Furthermore, in the transfer device 100, the power supply 110 applies a superposed voltage to the backup roller 109C at the second transfer portion N2. That is, in the transfer device 100, because the power supply 110 also serves as the transfer power supply that applies a transfer voltage at the second transfer portion N2, no other power supply or electrode member is needed. Hence, in the transfer device 100, the number of components of the voltage application unit is reduced, compared with a configuration in which the power supply 110 does not serve as the transfer power supply.

Furthermore, in the image forming apparatus 10 shown in FIG. 1, because generation of residual images in the first transfer portions N1 is suppressed, an image fault due to generation of residual images in the first transfer portions N1 is suppressed.

In the transfer device 100 shown in FIG. 4A, when the power supply 110 applies a voltage to the backup roller 109C, an electric current flows from the backup roller 109C to the transfer roller 106. At this time, an electric current flows in the direction X (surface direction of the intermediate transfer belt 102), in the region within the distance L1, and an electric current flows from the intermediate transfer belt 102 to the second transfer roller 106, in the direction Z, at the position (point) PA. As a result, at the position PA, the toner T moves in the direction Z from the intermediate transfer belt 102 to a recording sheet P, across a space, thus being transferred to the recording sheet P. When the polarity of the power supply 110 is changed, the direction of the electric current flowing between the backup roller 109C and the second transfer roller 106 is reversed, reversing the direction of the electric field at the position PA (direction Z) and the direction of the electric field acting on the surface of the intermediate transfer belt 102 in the region within the distance L1.

Accordingly, when the transfer device 100 is to erase the charging history of the intermediate transfer belt 102 simultaneously with the second transfer of the toner T, by changing the polarity of the power supply 110, the direction of the electric field generated in the space between the intermediate transfer belt 102 and the recording sheet P at the position PA and the direction of the electric field generated in the surface direction inside the intermediate transfer belt 102 in the region within the distance L1 change. At this time, at the position PA, the toner T repeats vibration in the direction Z, between the intermediate transfer belt 102 and the recording sheet P. As a result, in the transfer device 100, blurring of the toner image in the direction X is suppressed, and the charging history left on the intermediate transfer belt 102 is erased in the region within the distance L1.

Residual Image Evaluation

In the transfer device 100 shown in FIG. 4A, if the distance L1 is too long, an appropriate voltage may not be applied across the backup roller 109C and the second transfer roller 106, making it difficult for the charges to move in the surface direction E, whereas if the distance L1 is too short, unwanted surface discharge may occur, causing electrical degradation (for example, breakdown) of the intermediate transfer belt 102. Hence, residual image evaluation is performed to identify the range of adoptable distance L1 according to the resistivity (time constant) of the intermediate transfer belt 102.

The residual image evaluation is performed on three intermediate transfer belts 102 having a surface resistivity of the upper layer 102B of 11.5, 12.5, and 13.5 log Ω/□, by visually checking the presence/absence of residual images for each of the cases where the distance L1 is set to 0, 5, 10, 15, and 20 mm. The evaluation is performed at a temperature of 22° C. and a humidity of 55%, and a transportation speed (process speed) of the recording sheet P of 440 mm/s.

As fixed conditions, the thickness of the lower layer 102A of the intermediate transfer belt 102 is set to 33 μm, the surface resistivity of the lower layer 102A is set to 10.3 log Ω/□, and the thickness of the upper layer 102B is set to 67 μm. The front-side resistivity (surface resistivity of the upper layer 102B) is obtained by measuring the electrical resistance after a voltage of 500 V has been applied for ten seconds (reference: JIS K 6911).

Furthermore, the backup roller 109C has a diameter of 20 mm, a volume resistivity of 6.5 log Ω, and an Asker C hardness of 65°, and the second transfer roller 106 has a diameter of 24 mm, a volume resistivity of 7.0 log Ω, and an Asker C hardness of 75°. Furthermore, the voltage applied to the backup roller 109C has a direct-current component of 1.0 kV, a frequency of 700 Hz, and an amplitude of 2.3 kV. The results of the residual image evaluation are shown in Table 1. The results are evaluated in three ranks (good: there are no visible residual images, fair: there are no visible residual images, but is electrical degradation (breakdown) of the intermediate transfer belt, and poor: there are visible residual images).

TABLE 1

| front-side | distance L1 | | | | |
|---|---|---|---|---|---|
| resistivity | 0 mm | 5 mm | 10 mm | 15 mm | 20 mm |
| 11.5 logΩ/□ | poor | fair | fair | fair | good |
| 12.5 logΩ/□ | poor | fair | fair | good | poor |
| 13.5 logΩ/□ | poor | fair | good | poor | poor |

As shown in Table 1, generation of residual images is suppressed by setting distance L1 appropriate for the corresponding front-side resistivity. Furthermore, as a result of measuring the potential of the intermediate transfer belt 102 using a surface electrometer, it turns out that visible residual images are generated when the potential step between the image portion Sg and the non-image portion Sh is 50 V or more and is generated when the potential step is 10 V or less.

Second Exemplary Embodiment

Next, an example of a transfer device and image forming apparatus according to a second exemplary embodiment of the present invention will be described. Members and portions that are basically the same as those according to the first exemplary embodiment will be denoted by the same reference numerals as in the first exemplary embodiment, and descriptions thereof will be omitted.

Figure 6:
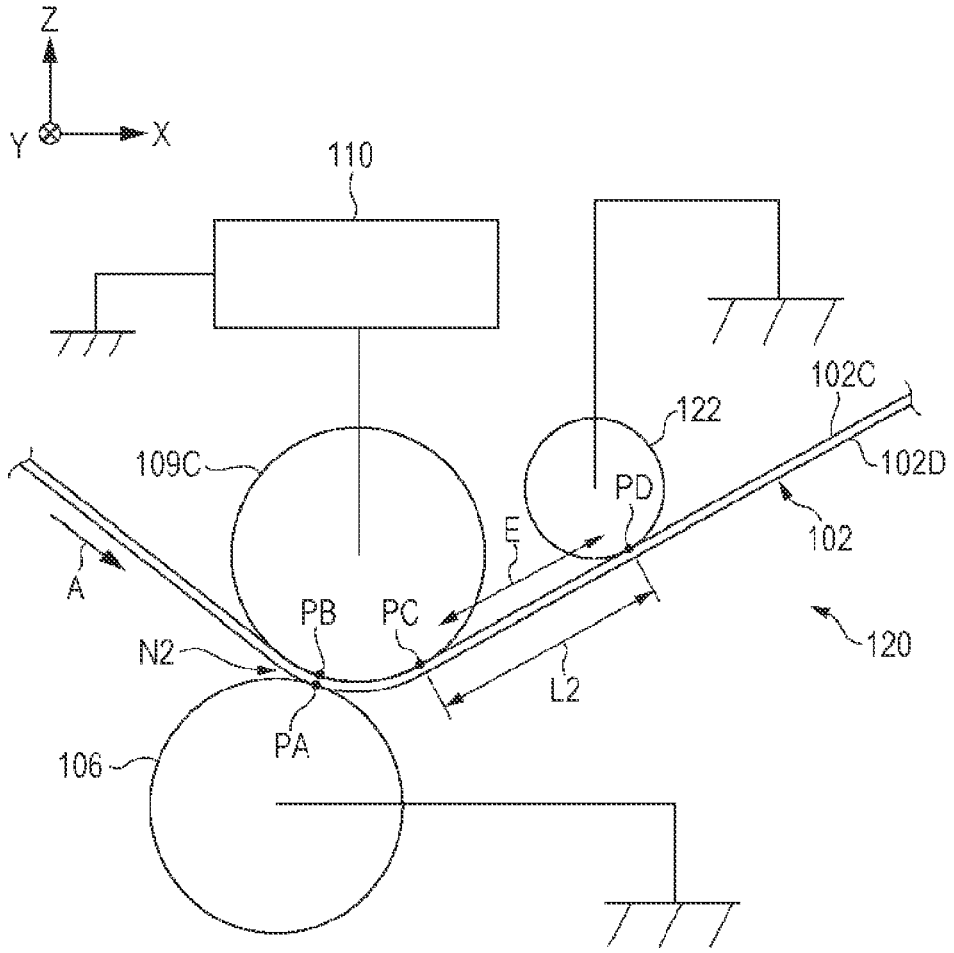
FIG. 6 is a schematic diagram showing the configuration of a second transfer portion of a transfer device and the vicinity thereof according to a second exemplary embodiment.

FIG. 6 shows a second transfer portion N2 of a transfer device 120 and the vicinity thereof according to the second exemplary embodiment. The transfer device 120 is provided instead of the transfer device 100 (see FIG. 1) in the image forming apparatus 10 according to the first exemplary embodiment (see FIG. 1). The transfer device 120 has the same configuration as the transfer device 100, except for the second transfer portion N2.

The transfer device 120 does not have the winding roller 108, which is provided in the transfer device 100, at the second transfer portion N2, and the backup roller 109C and the second transfer roller 106 are provided facing each other with the intermediate transfer belt 102 therebetween. As viewed in the direction Y, the intermediate transfer belt 102 is wound on the outer circumferential surface of the backup roller 109C, at a portion from the point PB (described above) to a point PC on the downstream side in the rotation direction. The power supply 110 is electrically connected to the backup roller 109C, which is an example of a second-transfer electrode member. The second transfer roller 106 is grounded.

Similarly to the first exemplary embodiment, the power supply 110 applies a superposed voltage, in which an ac voltage for changing polarity is superposed on a transfer voltage used for the second transfer at the second transfer portion N2, and the power supply 110 also serves as the transfer power supply.

The transfer device 120 also has a downstream-side roller 122, which is an example of a downstream-side electrode member and whose outer circumferential surface is in contact with the inner circumferential surface 102C of the intermediate transfer belt 102, on the downstream side of the second transfer portion N2 in the direction A (between the second transfer portion N2 and the first transfer portions N1 (see FIG. 2)).

The downstream-side roller 122 is made of, for example, stainless steel (SUS) and has a shaft (not shown) serving as a rotation shaft. The shaft is parallel to the backup roller 109C and the second transfer roller 106 and is supported by bearing members (not shown) at both ends in the direction Y so as to be rotatable. The shaft is grounded. The bearing members supporting the downstream-side roller 122 are fixed so that the center of rotation does not move.

The outer circumferential surface of the intermediate transfer belt 102 is in contact with the outer circumferential surface of the downstream-side roller 122 at a point PD. The distance between the backup roller 109C and the downstream-side roller 122 is assumed to be the distance L2, which is the distance between the point PC and the point PD in the direction A. The distance L2 is set to, for example, about 10 mm. Note that FIG. 6 does not show the actual dimensional relationship between these components.

Advantages

Next, advantages of the second exemplary embodiment will be described.

As shown in FIG. 6, in the transfer device 120 according to the second exemplary embodiment, when the power supply 110 applies a superposed voltage to the backup roller 109C, a transfer current flows from the backup roller 109C to the second transfer roller 106 through the intermediate transfer belt 102. As a result, at the second transfer portion N2, a toner image TA (see FIG. 2) on the intermediate transfer belt 102 is second-transferred to a recording sheet P (see FIG. 1) passing through the second transfer portion N2.

Furthermore, in the transfer device 120, the backup roller 109C and the downstream-side roller 122 are disposed at the distance L2 from each other in the direction A. Thus, in the transfer device 120, when a superposed voltage is applied to the backup roller 109C by the power supply 110, a potential difference is generated between the backup roller 109C and the downstream-side roller 122.

After the toner image TA1 is second-transferred, the amount of residual charge in the image portions Sg of the intermediate transfer belt 102 (see FIG. 5A) is lower than that in the non-image portions Sh (see FIG. 5A), because the charges are exchanged between the intermediate transfer belt 102 and the toner image TA1. As a result, potential steps are created at the boundaries of the image portions Sg and the non-image portions Sh.

Next, while the portion of the intermediate transfer belt 102 on which the second transfer was performed is moving from the point PC to the point PD in the direction A, the direction of the superposed voltage applied by the power supply 110 at this portion is the surface direction E of the intermediate transfer belt 102 (the direction A). That is, the power supply 110 applies a superposed voltage, which includes an ac voltage having a polarity that alternates in the direction A, to the intermediate transfer belt 102, between the second transfer portion N2 and the first transfer portions N1 (see FIG. 3).

As a result, as shown in FIG. 5B, in the upper layer 102B of the intermediate transfer belt 102, the polarity changes in the surface direction E, and the charges move at the boundaries of the image portions Sg and the non-image portions Sh. Thus, the amount of residual charges in the image portions Sg and that in the non-image portions Sh become uniform.

Subsequently, as shown in FIG. 5C, when the intermediate transfer belt 102 revolves in the circumferential direction and reaches the first transfer portions N1, toner images TA2, which are formed in the second image formation and are different from the toner images TA1, are first-transferred from the photoconductors 21 to the intermediate transfer belt 102. At this time, because the amount of residual charges in the image portions Sg and that in the non-image portions Sh have been made uniform (i.e., the potential steps have been reduced), in the toner image TA2 first-transferred to the intermediate transfer belt 102, the amount of toner deposited on the previous image portions Sg and that on the previous non-image portions Sh are uniform. Hence, in the transfer device 120 (see FIG. 6), generation of residual images in the first transfer portions N1 is suppressed.

In the image forming apparatus 10 shown in FIG. 1, because generation of residual images in the first transfer portions N1 is suppressed, image fault due to generation of residual images in the first transfer portions N1 is suppressed.

Furthermore, in the transfer device 120, as described above, a superposed voltage is applied to the backup roller 109C and the downstream-side roller 122, which serve as an example of two electrode members and are provided at the distance L2 from each other. Thus, movement of charges at the boundaries of the image portions Sg and the non-image portions Sh may be controlled not only by changing the amplitude and frequency of the superposed voltage from the power supply 110, but also by changing the distance L2. Thus, in the transfer device 120, generation of residual images in the first transfer portions N1 is further suppressed, compared with a configuration in which such two electrode members are not used.

Furthermore, in the transfer device 120, generation of residual images is suppressed by adding the grounded downstream-side roller 122 to the conventional configuration in which the backup roller 109C and the second transfer roller 106 face each other with the intermediate transfer belt 102 therebetween. Thus, without drastically changing the structure of the existing transfer device, generation of residual images is suppressed.

In addition, in the transfer device 120, because the power supply 110 also serves as the transfer power supply, no other power supply is needed. Thus, in the transfer device 120, the number of components of the voltage application unit is smaller than a configuration in which the power supply 110 does not serve as the transfer power supply.

Figure 7:
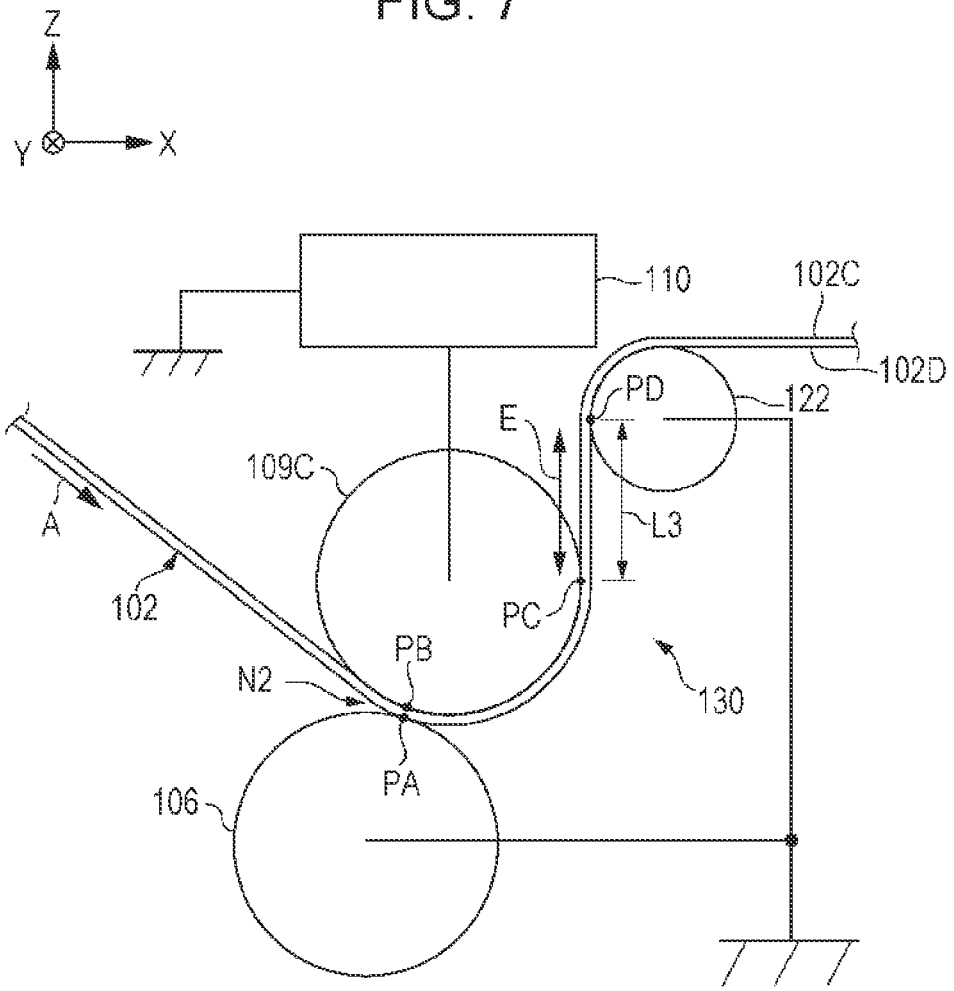
FIG. 7 is a schematic diagram showing the configuration of a second transfer portion of a transfer device and the vicinity thereof according to a modification of the second exemplary embodiment.

As shown in FIG. 7, a transfer device 130 may be used as a modification of the transfer device 120 according to the second exemplary embodiment. In the transfer device 130, the downstream-side roller 122 is not provided inside the intermediate transfer belt 102, but is provided outside the intermediate transfer belt 102, and the outer circumferential surface of the downstream-side roller 122 is in contact with the outer circumferential surface 102D of the intermediate transfer belt 102. In the transfer device 130, a superposed voltage having a polarity that alternates in the surface direction E is applied in the area within the distance L3, between the point PC of the backup roller 109C and the point PD of the downstream-side roller 122.

Third Exemplary Embodiment

Next, an example of a transfer device and image forming apparatus according to a third exemplary embodiment of the present invention will be described. Members and portions that are basically the same as those according to the first and second exemplary embodiments will be denoted by the same reference numerals as in the first and second exemplary embodiments, and descriptions thereof will be omitted.

Figure 8:
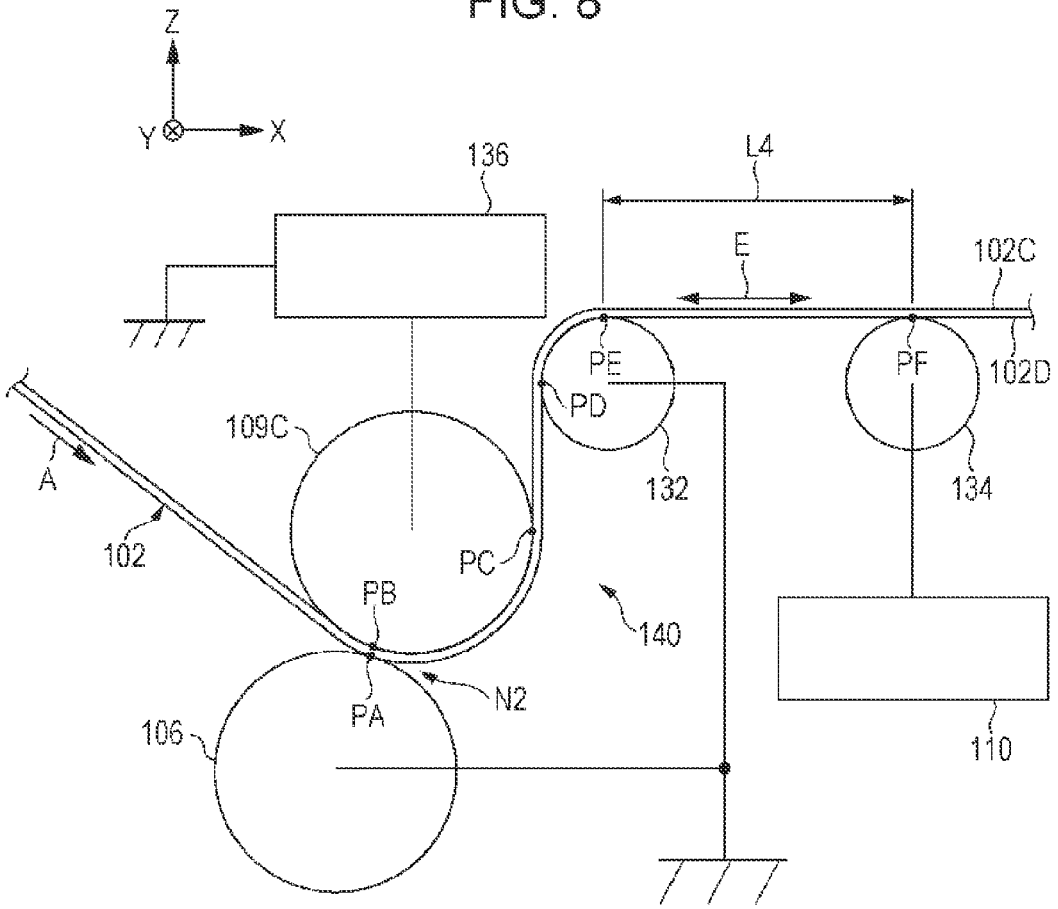
FIG. 8 is a schematic diagram showing the configuration of a second transfer portion of a transfer device and the vicinity thereof according to a third exemplary embodiment.

FIG. 8 shows the second transfer portion N2 of a transfer device 140 and the vicinity thereof according to the third exemplary embodiment. The transfer device 140 is provided instead of the transfer device 100 (see FIG. 1), in the image forming apparatus 10 according to the first exemplary embodiment (see FIG. 1). The transfer device 140 has the same configuration as the transfer device 100, except for the second transfer portion N2.

Furthermore, in the transfer device 140, instead of the downstream-side roller 122 (see FIG. 6) of the transfer device 120 according to the second exemplary embodiment, a first auxiliary roller 132, which is an example of a first auxiliary electrode member, and a second auxiliary roller 134, which is an example of a second auxiliary electrode member, are provided. Furthermore, in the transfer device 140, instead of the power supply 110, the transfer power supply 136 for applying a transfer voltage (for example, a dc voltage) at the second transfer portion N2 is electrically connected to the backup roller 109C.

The first auxiliary roller 132 is made of, for example, SUS and has a shaft (not shown) serving as a rotation shaft. The shaft is parallel to the backup roller 109C and is supported by bearing members (not shown) at both ends in the direction Y so as to be rotatable. The shaft is grounded. The bearing members supporting the first auxiliary roller 132 are fixed so that the rotation center does not move.

Furthermore, the outer circumferential surface of the first auxiliary roller 132 is in contact with the outer circumferential surface 102D of the intermediate transfer belt 102, on the downstream side of the second transfer portion N2 in the direction A. The intermediate transfer belt 102 is wound around the outer circumferential surface of the first auxiliary roller 132, at a portion from the point PD to the point PE, as viewed from the direction Y.

The second auxiliary roller 134 is made of, for example, SUS and has a shaft (not shown) serving as a rotation shaft. The shaft is parallel to the first auxiliary roller 132 and is supported by bearing members (not shown) at both ends in the direction Y so as to be rotatable. The bearing members supporting the second auxiliary roller 134 are fixed so that the rotation center does not move. Furthermore, the above-described power supply 110 is electrically connected to the shaft of the second auxiliary roller 134. In the third exemplary embodiment, the power supply 110 does not serve as the transfer power supply, and the power supply 110 applies an ac voltage having an alternating polarity.

Furthermore, the outer circumferential surface of the second auxiliary roller 134 is in contact with the outer circumferential surface 102D of the intermediate transfer belt 102, on the downstream side of the first auxiliary roller 132 in the direction A (direction X). The second auxiliary roller 134 and the intermediate transfer belt 102 are in contact with each other at a point PF.

The distance, L4, between the point PE at the first auxiliary roller 132 and the point PF at the second auxiliary roller 134 is set to, for example, about 10 mm. FIG. 8 does not show the actual dimensional relationship between these components.

As described above, the power supply 110 applies a voltage having an alternating polarity, which is a sinusoidal ac voltage, to the second auxiliary roller 134. Because the first auxiliary roller 132 is grounded, the power supply 110 applies the alternating polarity voltage across the first auxiliary roller 132 and the second auxiliary roller 134.

Advantages

Next, advantages of the third exemplary embodiment will be described.

As shown in FIG. 8, in the transfer device 140 according to the third exemplary embodiment, when the power supply 136 applies a DC voltage to the backup roller 109C, a transfer current flows from the backup roller 109C to the second transfer roller 106 through the intermediate transfer belt 102. As a result, at the second transfer portion N2, a toner image TA (see FIG. 2) on the intermediate transfer belt 102 is second-transferred to a recording sheet P (see FIG. 1) passing through the second transfer portion N2.

Furthermore, in the transfer device 140, the first auxiliary roller 132 and the second auxiliary roller 134 are disposed at the distance L4 from each other in the direction A. Thus, in the transfer device 140, when an AC voltage is applied to the second auxiliary roller 134 by the power supply 110, a potential difference is generated between the first auxiliary roller 132 and the second auxiliary roller 134.

When the power supply 136 also applies an ac voltage serving as a transfer voltage, while the portion of the intermediate transfer belt 102 on which the second transfer was performed is moving from the point PC to the point PD in the direction A, the polarity changes in the surface direction E in the upper layer 102B of the intermediate transfer belt 102. As a result, the charges move at the boundaries of the image portions Sg and the non-image portions Sh.

Next, while the portion of the intermediate transfer belt 102 on which the second transfer was performed is moving from the point PD to the point PF in the direction A, the direction of the AC voltage applied by the power supply 110 is the surface direction E of the intermediate transfer belt 102. That is, the power supply 110 applies an AC voltage having a polarity that alternates in the surface direction E (direction A) to the intermediate transfer belt 102, between the second transfer portion N2 and the first transfer portions N1 (see FIG. 3).

As a result, as shown in FIG. 5B, in the upper layer 102B of the intermediate transfer belt 102, the polarity changes in the surface direction E, and the charges move at the boundaries of the image portions Sg and the non-image portions Sh. Thus, the amount of residual charges in the image portions Sg and that in the non-image portions Sh become uniform.

Subsequently, as shown in FIG. 5C, when the intermediate transfer belt 102 revolves in the circumferential direction and reaches the first transfer portions N1, toner images TA2, which are formed in the second image formation and are different from the toner images TA1, are first-transferred from the photoconductors 21 to the intermediate transfer belt 102. At this time, because the amount of residual charges in the image portions Sg and that in the non-image portions Sh have been made uniform (i.e., the potential steps have been reduced), in the toner image TA2 first-transferred to the intermediate transfer belt 102, the amount of toner deposited on the previous image portions Sg and that on the previous non-image portions Sh are uniform. Hence, in the transfer device 140 (see FIG. 8), generation of residual images in the first transfer portions N1 is suppressed.

In the image forming apparatus 10 shown in FIG. 1, because generation of residual images in the first transfer portions N1 is suppressed, image fault due to generation of residual images in the first transfer portions N1 is suppressed.

Furthermore, in the transfer device 140, an AC voltage is applied to the intermediate transfer belt 102 using the power supply 110, which is different from the power supply 136 used for the second transfer of the toner image TA. Thus, in the transfer device 140, a voltage having a level, amplitude, and frequency that are different from those of the second transfer voltage may be applied to the second auxiliary roller 134, independently of the second transfer voltage.

The present invention is not limited to the above-described exemplary embodiments.

The transfer member is not limited to the belt (intermediate transfer belt 102), but may be any cylindrical member (drum), as long as a superposed voltage having a polarity that alternates in the surface direction may be applied thereto.

The electrode member is not limited to the roller, which rotates, but may be a fixed member over which the intermediate transfer belt 102 slides.

The backup roller 109C may be grounded, and the second transfer roller 106 may be connected to the power supply 110. That is, the second transfer roller 106 may be an example of a first electrode member and second-transfer electrode member, and the backup roller 109C may be an example of a second electrode member.

The first auxiliary roller 132 and the second auxiliary roller 134 do not necessarily have to be in contact with the outer circumferential surface 102D of the intermediate transfer belt 102, but may be in contact with the inner circumferential surface 102C. Furthermore, one of the first auxiliary roller 132 and the second auxiliary roller 134 may be in contact with the outer circumferential surface 102D, and the other may be in contact with the inner circumferential surface 102C. Furthermore, the second auxiliary roller 134 may be grounded, and the first auxiliary roller 132 may be connected to the power supply 110.

What is claimed is:

1. A transfer device comprising:

a transfer member provided so as to be able to revolve; and a voltage application unit, wherein the transfer member has an upper layer and a lower layer arranged in a thickness direction, the upper layer has a larger volume resistivity than the lower layer, wherein the transfer member receives a developer image transferred from an image bearing member to the upper layer at a first transfer portion and transfers the developer image to a recording medium at a second transfer portion, and wherein the voltage application unit applies an alternating-current voltage having a polarity that alternates in a moving direction of the transfer member to the transfer member, between the second transfer portion and the first transfer portion, wherein the voltage application unit includes two electrode members that are provided at a distance from each other in the moving direction of the transfer member and that are in contact with the transfer member, and a power supply that applies an alternating-current voltage across the two electrode members via the transfer member, wherein the transfer member is an endless belt, wherein the two electrode members include a first auxiliary electrode member that is in contact with the lower layer or upper layer of the belt, at a position downstream of the second transfer portion in the moving direction of the transfer member, and a second auxiliary electrode member that is in contact with the lower layer or upper layer of the belt, at a position downstream of the first auxiliary electrode member in the moving direction of the transfer member, wherein the first auxiliary electrode member is closer than other members that are in contact with the lower layer or upper layer of the belt, at a position downstream of the second transfer portion in the moving direction of the transfer member.

2. The transfer device according to claim 1, wherein the transfer member is an endless belt, wherein the two electrode members further comprise a second electrode member that is in contact with the upper layer of the belt at the second transfer portion, and wherein the power supply also serves as a transfer power supply that applies a transfer voltage.

3. The transfer device according to claim 1, wherein the transfer member is an endless belt, wherein the two electrode members further comprising a downstream-side electrode member that is in contact with the lower layer or upper layer of the belt, at a position downstream of the second transfer portion in the moving direction, and wherein the power supply also serves as a transfer power supply that applies a transfer voltage.

4. An image forming apparatus comprising:

an image bearing member;

a transfer member provided so as to be able to revolve; and a voltage application unit, wherein the transfer member has an upper layer and a lower layer arranged in a thickness direction, the upper layer has a larger volume resistivity than the lower layer, wherein the transfer member receives a developer image transferred from the image bearing member to the upper layer at a first transfer portion and transfers the developer image to a recording medium at a second transfer portion, and wherein the voltage application unit applies an alternating-current voltage having a polarity that alternates in a moving direction of the transfer member to the transfer member, between the second transfer portion and the first transfer portion, wherein the voltage application unit includes two electrode members that are provided at positions adjacent each other along the transfer member and at a distance from each other in the moving direction of the transfer member and that are in contact with the transfer member, and a power supply that applies an alternating-current voltage across the two electrode members via the transfer member.

5. The image forming apparatus according to claim 4, wherein the transfer member is an endless belt, wherein the two electrode members include a first electrode member that is in contact with the lower layer of the belt at the second transfer portion, and a second electrode member that is in contact with the upper layer of the belt at the second transfer portion, and wherein the power supply also serves as a transfer power supply that applies a transfer voltage.

6. The image forming apparatus according to claim 4, wherein the transfer member is an endless belt, wherein the two electrode members include an upstream-side electrode member that is in contact with the lower layer or upper layer of the belt at the second transfer portion, and a downstream-side electrode member that is in contact with the lower layer or upper layer of the belt, at a position downstream of the second transfer portion in the moving direction of the transfer member, and wherein the power supply also serves as a transfer power supply that applies a transfer voltage.

7. The image forming apparatus according to claim 4, wherein the transfer member is an endless belt, wherein the two electrode members include a first auxiliary electrode member that is in contact with the lower layer or upper layer of the belt, at a position downstream of the second transfer portion in the moving direction of the transfer member, and a second auxiliary electrode member that is in contact with the lower layer or upper layer of the belt, at a position downstream of the first auxiliary electrode member in the moving direction of the transfer member.

8. A transfer device comprising:

a transfer member provided so as to be able to revolve; and a voltage application unit, wherein the transfer member has an upper layer and a lower layer arranged in a thickness direction, the upper layer has a larger volume resistivity than the lower layer, wherein the transfer member receives a developer image transferred from an image bearing member to the upper layer at a first transfer portion and transfers the developer image to a recording medium at a second transfer portion, and wherein the voltage application unit applies an alternating-current voltage having a polarity that alternates in a moving direction of the transfer member to the transfer member, between the second transfer portion and the first transfer portion, wherein the voltage application unit includes a first electrode and a second electrode that are provided at a distance from each other in the moving direction of the transfer member and that are in contact with the transfer member, and the voltage application unit provides an alternating-current voltage to the second electrode, the second electrode being disposed in contact with the lower layer of the transfer member.

* * * * *